United States Patent [19]

Hubred

[11] 4,382,845

[45] May 10, 1983

[54] SELECTIVE ELECTROWINNING OF PALLADIUM

[75] Inventor: Gale L. Hubred, Richmond, Calif.

[73] Assignee: Chevron Research Company, San Francisco, Calif.

[21] Appl. No.: 291,607

[22] Filed: Aug. 10, 1981

[51] Int. Cl.[3] ..... C25C 1/20

[52] U.S. Cl. ..... 204/111; 204/1 T; 204/47; 356/300

[58] Field of Search ..... 204/109, 111, 130, 43, 204/47, 1 T; 356/300

[56] References Cited

FOREIGN PATENT DOCUMENTS 454280 10/1972 U.S.S.R. ..... 204/43 N

OTHER PUBLICATIONS

Chemical Abstracts 94:34295f.

Kirk-Othmer, *Encyclopedia of Chemical Technology*, 2d Ed., vol. 15, pp. 843-847.

*Primary Examiner*—R. L. Andrews

*Attorney, Agent, or Firm*—D. A. Newell; S. R. LaPaglia; C. L. Hartman

[57] ABSTRACT

A process for electrowinning palladium values from an aqueous solution that contains platinum and palladium.

4 Claims, 2 Drawing Figures

SELECTIVE ELECTROWINNING OF PALLADIUM

BACKGROUND OF THE INVENTION

This invention pertains to methods of producing precious metals electrolytically from solutions and in particular methods of producing palladium from solutions containing palladium and platinum.

In natural ores the metals platinum and palladium are frequently associated with each other. Ores are known that have much more palladium than platinum. A method of enriching the relative concentrations of platinum to palladium would be very useful for processing these ores. The conventional method of recovering platinum from a solution of platinum and palladium involves precipitating ammonium platinum VI hexachloride to a solution containing platinum hexachloride and palladium tetrachloride.

A process for the separation and recovery of noble metals disclosed in Chemical Abstracts 94:34295f show the electrowinning of both platinum and palladium from a solution that contains other metal ions. Neither platinum nor palladium was selectively removed.

SUMMARY OF THE INVENTION

The present invention provides a method for selectively electrowinning palladium metal from a first solution that contains more palladium by weight than platinum prepared by dissolving palladium and platinum in at least 1 molar hydrochloric acid.

The first solution is in contact with a cathode, in a cathode compartment of an electrowinning cell, separated from an anode by a cation permeable membrane. The anode is in contact with a second solution consisting of at least 0.5 molar hydrochloric acid. Electric current is passed across the anode and cathode. Palladium is selectively electrowon until the concentrations of platinum and palladium are substantially equal.

DETAILED DESCRIPTION

Figure 1:
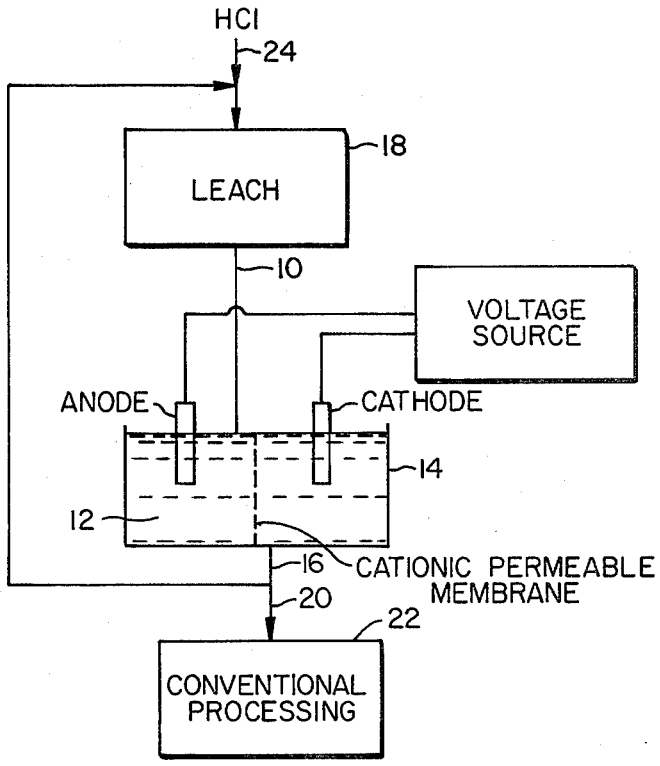
FIG. 1 shows flow scheme for one embodiment of this invention.

Platinum and palladium are known to be associated with one another in naturally occurring ores along with other platinum group metals and gold and silver. Various chemical processes are known that selectively separate platinum from palladium. An example of such processes is shown in Kirk-Othmer's *Encyclopedia of Chemical Technology,* Second Edition, in Volume 15, pages 843–847. The process shown therein shows precipitation of platinum hexachloride with ammonium ion which selectively precipitates only the platinum and does not precipitate the palladium chloride.

It has been found that in a concentrated hydrochloric acid solution containing platinum and palladium ions, palladium can be selectively be removed by electrolysis of the solution, if concentration of palladium is greater than the concentration of platinum. Such solutions can be obtained as the leach liquor from ores herein defined as either naturally occurring or artificial, such as scrap metal, containing more palladium than platinum. It will be appreciated by those skilled in the art, that a leach solution for noble metals will many times be the mixture of nitric and hydrochloric acids, known as aqua regia. Any other solution that will dissolve the metals from the ore will be satisfactory as long as it contains at least 1 M hydrochloric acid. Dissolving the metals from the ore is done in what is herein defined as a leach tank. A beaker containing chloride salts of platinum and palladium is, upon addition of hydrochloric acid, defined as a leach tank. Solutions of hydrochloric acid and platinum (IV) hexachloride and palladium (II) tetrachloride will be made which can then be used as electrolyte for recovery of metal, if hydrochloric acid containing solution is used to leach platinum and palladium from an ore. If an ore contains substantially more palladium than platinum, electrolysis of the hydrochloric acid leach solution can provide an enriched source of platinum for conventional treating, as well as pure palladium metal plated onto the cathode.

The cell for this invention is constructed by partitioning a cell containing the aqueous acidic solution with a cation permeable membrane. The metal ions, in a first solution as platinum (IV) hexachloride and palladium (II) tetrachloride, are placed in the cathode compartment. As reaction proceeds, the palladium initially plates out on the cathode. It has been observed that platinum will not plate out until the concentration of platinum is about equal to the concentration of palladium, when concentration is measured in grams per liter. In the bulk process of this invention, that is, when the cell is charged with pregnant liquor and voltage applied until platinum starts to plate out, monitoring of the relative concentrations of the metals in the solution is necessary if plating of the cathode with platinum is to be avoided. This can be done by analyzing aliquots of electrolyte by atomic absorption spectroscopy. The anode is in contact with a second solution that must be at least 0.5 molar hydrochloric acid. The second solution may have metal ions in its as well. Both the anode and the cathode must be made from non-corroding material, such as titanium. The applied voltage across the cell is typically about 1.5 volts, and should not exceed about 5 volts.

An embodiment of this invention, is schematically represented in FIG. 1., a leach-electrolysis cycle where the pregnant liquor from the hydrochloric acid leach 10 is continuously supplied to the anode compartment 12 of the cell 14. Electrolyte 16 is bled from the cell and recycled to the leach tank 18 where it further dissolves platinum and palladium from the ore. In this way the leach solution becomes increasingly concentrated with platinum. A bleed stream 20 removes platinum enriched electrolyte for conventional platinum processing 22. Make up hydrochloric acid 24 can be added to the stream to maintain volume in the system. The flow rates are determined by analysis of the concentrations of metals in the bleed stream. As long as the bleed stream has more palladium than platinum, the metal plating out on the cathode will be essentially all palladium.

EXAMPLE

Figure 2:
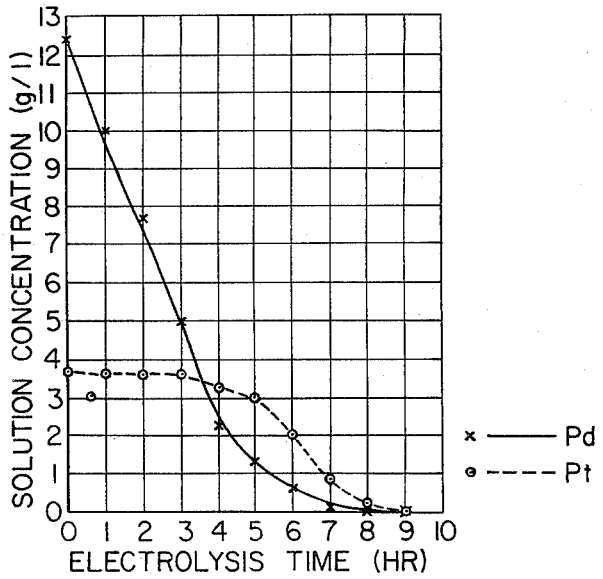
FIG. 2 shows a graphical representation of relative concentrations of platinum and palladium in the operation of this invention.

The following example shows one embodiment of the present invention and is not intended to be limiting. A mixture of 100 ml of a solution that is 22.1 grams platinum per liter of solution made from $H_2PtCl_6$ in water and 300 ml of a solution that is 60.0113 grams palladium per liter of solution made from dissolving $PdCl_2$ in 1.0 M HCl was prepared for cathode compartment. A 4.00 percent HCl solution was prepared for an anode compartment. A cell was prepared by dividing a container with a NAFION membrane obtainable from DuPont that had been pretreated by boiling for 30 minutes in 10% sulfuric acid and wet mounted. A 30 mm×50 mm piece of platinum gauze was used as the anode and a 20 mm×45 mm piece of expanded titanium was used as cathode. An electric current of 1.5 volts from a Hewlett-Packard 6428B DC Power Supply was passed through the solution and the concentrations of platinum and palladium measured approximately every one-half hour by atomic absorption. Results are shown in FIG. 2.

It will be seen that there was no detectable difference in concentration in platinum until the concentrations of platinum and palladium were nearly equal. This provides a gauge for commercial plant operation utilizing the flow scheme of FIG. 1.

What is claimed is:

1. A process for selectively removing palladium from a mixture containing more palladium by weight than platinum comprising:

forming a first solution in a leach tank, which contains at least 1 M hydrochloric acid, and said palladium and platinum;

contacting said first solution with a cathode, said cathode in a compartment in a cell separated from an anode by a cation permeable membrane, said anode in contact with a second solution consisting of at least 0.5 molar hydrochloric acid; and passing electric current across said anode and cathode until the concentration of palladium and platinum is substantially equal in said first solution, when said concentrations are measured in grams of metal per liter.

2. The process of claim 1 further including monitoring the concentrations of metals in the solutions by atomic absorption spectroscopy.

3. The process of claim 1 wherein the voltage of the electric energy does not exceed 5 volts.

4. The process of claim 1 further comprising recycling the solution from said cell to said leach tank.

* * * * *